US010334894B2

(12) United States Patent
Axelsson

(10) Patent No.: US 10,334,894 B2
(45) Date of Patent: Jul. 2, 2019

(54) SEALING ARRANGEMENT FOR GARMENTS

(71) Applicant: SI TECH AB, Brastad (SE)

(72) Inventor: Jonas Axelsson, Brastad (SE)

(73) Assignee: SI TECH AB, Brastad (SE)

( * ) Notice: Subject to any disclaimer, the term of this patent is extended or adjusted under 35 U.S.C. 154(b) by 0 days.

(21) Appl. No.: 15/765,760

(22) PCT Filed: Oct. 7, 2016

(86) PCT No.: PCT/EP2016/074060
§ 371 (c)(1),
(2) Date: Apr. 4, 2018

(87) PCT Pub. No.: WO2017/060467
PCT Pub. Date: Apr. 13, 2017

(65) Prior Publication Data

US 2018/0279695 A1 Oct. 4, 2018

(30) Foreign Application Priority Data

Oct. 9, 2015 (EP) ..... 15189155

(51) Int. Cl.
*A41D 13/00* (2006.01)
*B63C 11/04* (2006.01)
(Continued)

(52) U.S. Cl.
CPC ..... *A41D 13/0005* (2013.01); *B63C 11/04* (2013.01); *A62B 17/006* (2013.01); *B63B 2035/715* (2013.01); *B63C 2011/043* (2013.01)

(58) Field of Classification Search
CPC .... A45F 5/02; Y10T 24/3636; Y10T 24/3632; Y10T 24/3645; Y10T 24/3643;
(Continued)

(56) References Cited

U.S. PATENT DOCUMENTS 7,062,786 B2 6/2006 Stinton
8,042,237 B2 * 10/2011 Hart ..... F16L 3/2235 24/457
(Continued)

FOREIGN PATENT DOCUMENTS

EP 2868218 A1 5/2015
WO 9639055 A1 12/1996
WO 9923902 A1 5/1999

OTHER PUBLICATIONS

International Search Report and Written Opinion for International Application No. PCT/EP2016/074060, dated Jan. 30, 2017 (13 pages).

*Primary Examiner* — Robert Sandy
(74) *Attorney, Agent, or Firm* — RMCK Law Group, PLC

(57) ABSTRACT

A sealing arrangement for garments to sealingly connect an annular layer and a wearable layer to the sealing arrangement includes a sealing device and a reinforcement clip. The sealing device includes an annular sealing body and an annular base having inner and outer annular wall portions at least partly defining a recess in the annular base. The sealing device includes an annular sealing surface for sealingly connecting the annular layer to the annular base, and the annular sealing body is adapted to be locked into the recess to sealingly connect the wearable layer between the annular base and the annular sealing body. The reinforcement clip includes a sealing device locking portion arranged to be locked to the annular base, and a counteracting portion configured to, in use, counteract a relative movement of the outer and inner annular wall portions.

8 Claims, 5 Drawing Sheets

(51) Int. Cl.
*A62B 17/00* (2006.01)
*B63B 35/71* (2006.01)

(58) Field of Classification Search
CPC .. A44B 5/00; A44B 5/007; A44B 5/02; A44B 5/002; A62B 17/00–001; A62B 17/006
USPC ..... 277/590–654; 2/457
See application file for complete search history.

(56) References Cited

U.S. PATENT DOCUMENTS

2002/0178554 A1* 12/2002 Salice ..... E05D 5/0238 24/457
2002/0189007 A1* 12/2002 Cormier ..... A41D 19/0089 2/457
2016/0198782 A1* 7/2016 Thompson ..... A41F 1/002 2/162

* cited by examiner

SEALING ARRANGEMENT FOR GARMENTS

CROSS-REFERENCE TO RELATED APPLICATIONS

This application claims priority to International Application No. PCT/EP2016/074060 filed Oct. 7, 2016 and titled "A SEALING ARRANGEMENT FOR GARMENTS", which in turn claims priority from European Application having Ser. No. 15/189,155.3, filed on Oct. 9, 2015, both of which are incorporated herein by reference in their entireties.

TECHNICAL FIELD OF THE INVENTION

The present inventive concept relates to a sealing arrangement for garments, specifically to a sealing arrangement for sealingly connecting two layers in e.g. a fluid tight, water tight, gas tight and/or air tight relation. The present inventive concept also relates to a reinforcement clip.

BACKGROUND OF THE INVENTION

Garments in e.g. a diving suit, a protection suit, a spray deck of the cockpit in a kayak, etc. are often used to seal the wearer, or certain parts of the wearer, from e.g. a fluid such as water or contaminated air/gas. In e.g. a diving suit, the garment around the neck may need to be sealingly connected to a diving cap/helmet in order for the wearer to be sealed from the surroundings when diving. Similarly, the feet and hands of the wearer, i.e. garment around the wrists and cuffs of the diving suit, may need to be sealingly connected to diving gloves and diving boots, respectively. In another example, the paddler of a kayak often desires to prevent water from entering through the cockpit into the kayak, and therefore uses a wearable garment (a so called spray deck) which is sealingly connected to the kayak. Thus, for many applications, there is a need to sealingly connect a layer, e.g. the neck of a diving suit or portions around the cockpit of a kayak, to a wearable layer, e.g. a diving cap/helmet or the spray deck of a kayak, respectively.

A solution for sealingly connecting parts of a diving suit is presented in EP 1 352 577, where the diving suit is provided with releasable water-tight seals around the wrists, ankles and neck. Each releasable water-tight seal includes first and second complementary shaped annular interlocking seal members connected to the diving suit and suit elements such as gloves or boots, respectively. In EP 1 352 577 one member is provided with an undercut hook-shaped rib that mates with at least one complementary shaped channel in the other member.

The size and complex design of the sealing device in EP 1 352 577 makes it suitable for relatively advanced clothing, such as heavy diving suits and survival suits. However, there is a need for a smaller and simpler sealing device applicable to e.g. waterproof jackets.

In EP 2 868 218, a sealing device comprising an annular base with sections of different stiffness is provided. The annular base in EP 2 868 218 thus balance the need for a certain stiffness required to hold an annular sealing body in place, while still providing for a annular base which is flexible. However, for certain applications, there is a need for an improved stiffness and/or a more adaptable sealing device.

SUMMARY OF THE INVENTION

An object of the present inventive concept is to alleviate the drawbacks of prior art. This and other objects, which will become apparent in the following description, are accomplished by a sealing arrangement and a reinforcement clip as defined in the accompanying claims.

The present inventive concept is based on the realization that a sealing arrangement for garments to sealingly connect an annular layer and a wearable layer to the sealing arrangement, may be improved if the sealing arrangement comprises a sealing device in where the wearable layer is sealed in a recess by an annular sealing body, and a reinforcement clip arranged to be locked to the sealing device in order to further secure the annular sealing body in the recess. In an connected state, i.e. in a state where the reinforcement clip is connected to and locked to the sealing device, the sealing arrangement can withstand a relatively high external force without losing its sealing properties, i.e. without having the annular sealing body being released from the recess, as the reinforcement clip reinforces the sealing device by firmly holding and retaining the annular sealing body in the recess. In a disconnected state however, where the reinforcement clip is disconnected and separated from the sealing device, the sealing device has relatively high bendable properties and may be connected to the wearable layer and/or attached to the annular layer relatively easy. In other words, the sealing arrangement provides easy connection to the wearable layer as the sealing device may have rather high bendable properties, while still providing great sealing properties thanks to the reinforcement clip. Thus, the inventive concept is based on the combination of two conflicting interest. The first being to have a sealing arrangement which is secure enough to firmly hold and lock the annular sealing body in the recess in order to seal the wearable layer to the sealing device. The second being to have a sealing device which is flexible or bendable enough to facilitate connection to the wearable layer, and in order to be pliable adapted to the annular layer.

According to at least one aspect of the present inventive concept, a sealing arrangement for garments to sealingly connect an annular layer and a wearable layer to the sealing arrangement is provided. The sealing arrangement comprises a sealing device and a reinforcement clip, said sealing device comprising an annular sealing body and an annular base, said annular base comprising:

- an inner annular wall portion,
- an outer annular wall portion extending circumferentially around said inner annular wall portion,
- a recess at least partly defined by said inner and outer annular wall portions, and
- an annular sealing surface for circumferentially and sealingly connecting said annular layer to said annular base;

said annular sealing body being adapted to be locked into said recess to circumferentially and sealingly connect said wearable layer between said annular base and said annular sealing body;

said reinforcement clip comprising a sealing device locking portion arranged at a first end portion of said reinforcement clip, a counter acting portion arranged at a second end portion of said reinforcement clip, and a connecting portion connecting said sealing device locking portion and said counter acting portion;

wherein said sealing device locking portion is arranged to be locked to at least one of said inner annular wall portion and said outer annular wall portion of said sealing device and said counter acting portion is configured to, in use, counter act a relative movement of the outer and inner annular wall portions whereby the risk of said annular sealing body to be released from said recess is reduced.

In more detail, said counter acting portion, together with said sealing device locking portion and said connecting portion, at least partly counter acts a force which acts to deflect the inner annular and/or outer annular wall portions. Thus, the reinforcement clip prevents, or at least reduces the risk of, widening or enlarging the recess as movement of the inner annular and/or outer annular wall portions causing such widening or enlarging of the recess, are at least partly counter acted. That is, the reinforcement clip reduces the risk, or prevents, deflection of the inner annular and/or outer annular wall portions. In other words, said reinforcement clip at least partly reinforce a part of the sealing device, such as e.g. a portion of the annular base of the sealing device. The sealing arrangement of the inventive concept may preferably be used for relatively light-weight garments such as e.g. waterproof jackets, and/or to garments which may be subject to high external forces such as e.g. off-shore applications. The sealing arrangement may preferably also be used for diving suits.

It should be noted that for some embodiments, the inner annular wall portion and the outer annular wall portion may still move relative each other in at least one direction, e.g. if only one of the inner annular wall portion and the outer annular wall portion is gripped and moved in e.g. the radial direction inwardly towards a centre of the sealing device. Thus, according to at least one example embodiment, the counter acting portion is configured to, in use, counter act at least one relative movement of the outer and inner annular wall portions in order to reduce the risk of said annular sealing body to be released from said recess.

The reinforcement clip thus improves the sealing properties of the sealing device as it holds and secures the annular sealing body in the recess. Hereby, the sealing device, or at least the annular base of the sealing device, may be made with relatively high bendable properties and may therefore easily be connected to a wearable layer and the annular layer. Hence, thanks to the reinforcement clip, the sealing device, or at least the annular base of the sealing device may be made with such high bendable properties which otherwise would lead to poor sealing properties as the annular base would not be rigid enough to hold the annular sealing body inside the recess.

According to at least one example embodiment, the reinforcement clip is arranged to at least partly encompass a portion of the annular base. Thus, in the connected state, the reinforcement clip extends from at least one of the inner annular wall portion and outer annular wall portion of the sealing device, i.e. from the sealing device locking portion being locked to the sealing device, and extends further beyond the outer and/or inner annular wall portion, i.e. as the sealing device locking portion proceeds into the connecting portion. According to at least one example embodiment, the counter acting portion of the reinforcement clip is arranged to extend into the recess of the sealing device. According to at least one example embodiment, the counter acting portion is arranged to extend to at least the one of the inner annular wall portion and outer annular wall portion which the sealing device locking portion is not locked.

According to at least one example embodiment, the reinforcement clip is arranged to be clipped, or snap-locked to the sealing device According to at least one example embodiment, the reinforcement clip is arranged to extend from an outside of the sealing device to an inside of the sealing device. For example, the reinforcement clip may extend from the inner annular or outer annular wall portion and into the recess. However, according to one alternative example embodiment, the reinforcement clip is arranged to extend solely on the outside of the sealing device. For example from one of the inner annular wall portion and the outer annular wall portion to the other one of the inner annular or outer annular wall portions. It should here be understood that the outside of the sealing device is referring to any external section or surface of the sealing device, i.e. a section or surface not being an internally arranged section or surface, and the inside of the sealing device is referring to any section or surface arranged internally of the sealing device such as e.g. surfaces within the recess. For example, the inner annular wall portion comprises a surface facing radially inwardly to the sealing device, such surface being part of the outside of the sealing device as it is an externally arranged surface, the inner annular wall portion further comprises a surface facing the recess, such surface being part of the inside of the sealing device as it is an internally arranged surface.

According to at least one example embodiment, the reinforcement clip is U-shaped, wherein the sealing device locking portion is comprised in, or make up, one of the two parallel legs of the U-shape, the counter acting portion is comprised in, or make up, the other of the two parallel legs of the U-shape, and the connecting portion is comprised in, or make up, the connecting portion connecting the two parallel legs of the U-shape. Hereby, the U-shaped reinforcement clip may extend around at least a portion of the annular base of the sealing device, such as e.g. a portion extending from and beyond the inner annular or outer annular wall portion, or a portion extending from the inner annular or outer annular wall portion to the other one of the inner annular or outer annular wall portion.

According to at least one example embodiment, the sealing arrangement comprises a plurality of reinforcement clips. The reinforcement clip may be identical, or almost identical, to each other, or they may be designed differently to each other. It should be understood that the number of reinforcement clips may be chosen depending on the circumstances. For example, the number of reinforcement clips may be adapted to the specific situation and/or to the external force which the sealing arrangement is to withstand. For example, more reinforcement clips typically means that the sealing arrangement will be able to withstand a higher external force without losing it sealing properties compared to a sealing arrangement having fewer reinforcement clips. According to at least one example embodiment, reinforcement clips may be added or removed upon choice.

According to at least one example embodiment where the sealing arrangement comprises a plurality of reinforcement clips, the reinforcement clips may be connected to each other via some connecting means, such as e.g. a wire or thread. Hereby, the placement of the reinforcement clip in relation to the sealing device may be pre-defined by adapting the length of the connecting means between the reinforcement clips. Furthermore, the risk of dropping and losing a reinforcement clip is reduced if more reinforcement clips are connected to each other.

According to at least one example embodiment, at least one of said inner annular wall portion and said outer annular wall portion of said sealing device comprises a reinforcement clip-locking portion arranged to lock against said sealing device locking portion.

In other words, the reinforcement clip-locking portion and the sealing device locking portion is arranged to be locked to, or mate with, each other.

According to at least one example embodiment, said reinforcement clip-locking portion is formed as an indentation, and said sealing device locking portion is formed as a protrusion, and wherein said protrusion is arranged to be snap-locked into said indentation.

Hereby, a simple but yet effective means for locking the reinforcement clip to the sealing device is provided.

Said protrusion may also be referred to as a sealing device locking portion protrusion and said indentation may be referred to as an outer annular wall portion indentation and/or an inner annular wall portion indentation depending on if the indentation is arranged said outer annular wall portion and/or said inner annular wall portion of said sealing device. In other words said sealing device locking portion comprises a surface arranged to face a surface of said inner and/or outer annular wall portion.

Said protrusion may be referred to as a lip or a shoulder.

According to at least one alternative example embodiment, said reinforcement clip-locking portion is formed as a protrusion, and said sealing device locking portion is formed as an indentation, and wherein said protrusion is arranged to be snap-locked into said indentation.

According to at least one example embodiment, said counter acting portion comprises a base sub portion connected to said connecting portion, and a main protruding portion extending from said base sub portion at least partly in the same direction as said connecting portion, thereby forming a main reinforcement clip recess defined by at least a part of said connecting portion, at least a part of said base sub portion and at least a part of said main protruding portion.

It should be understood that the connecting portion and the main protruding portion has a main extension in at least partly the same direction. For example, the main protruding portion and the connecting portion may be at least partly parallel.

According to at least one example embodiment, the main reinforcement clip recess is arranged to receive at least an end portion of at least one of said inner annular wall portion and said outer annular wall portion of said sealing device.

According to at least one example embodiment, said main protruding portion is a first protruding portion and said main reinforcement clip recess is a first reinforcement clip recess, and said counter holding portion comprises a second protruding portion extending from said base sub portion at least partly in the same direction as said connecting portion, thereby forming a second reinforcement clip recess defined by at least a part of said base sub portion, at least a part of said first protruding portion and at least a part of said second protruding portion.

According to at least one example embodiment, said second reinforcement clip recess comprises an orifice which, in use (i.e. in the connected state), is configured to face at least a portion of said annular sealing body of said sealing device.

Hereby, if the sealing arrangement is subject to an external force acting to push out the annular sealing body from the recess, the second reinforcement clip recess functions as a receiving recess for the annular sealing body which reduces the risk of the sealing arrangement to lose it sealing properties.

According to at least one example embodiment, said counter acting portion comprises a protrusion and both of said inner annular and outer annular wall portions comprise an indentation, and wherein said protrusion of said counter acting portion is arranged to be snap-locked into one of said indentations.

In other words, said counter holding portion may be referred to as a second sealing device locking portion, as it is arranged to be snap-locked into said sealing device.

For example, the inner annular wall portion comprises an inner annular wall portion indentation arranged to be snap-locked to said protrusion of said counter acting portion, and the outer annular wall portion comprises an outer annular wall portion indentation arranged to be snap-locked to said protrusion of said sealing device locking portion.

Such embodiments are e.g. suitable for a sealing arrangement for a neck seal in where the reinforcement clip encompasses a portion of the base portion extending on the outside of the sealing device from the inner annular wall portion to the outer annular wall portion.

Said protrusion may be referred to as a lip or a shoulder.

According to at least one example embodiment, at least one of said inner annular wall portion and said outer annular wall portion is provided with a plurality of sections in the circumferential direction, each section having a stiffness different from a stiffness of a neighbouring section.

By providing/dividing at least one of said inner and outer annular wall portions with sections, wherein the stiffness of at least two neighbouring sections are different, the annular base portion may be more bendable/flexible and hence more pliable and adaptable to the annular layer.

According to at least one example embodiment, the reinforcement clip is arranged between two sections having the same stiffness. For example, the reinforcement clip may be arranged in a section having a relatively low stiffness compared to its neighbouring sections.

According to at least one example embodiment, in the connected state, a combined stiffness of a section of the sealing device comprising a reinforcement clip, and of the reinforcement clip, is equal to, or close to equal to, the stiffness of at least one of its neighbouring sections.

It should be understood that when referring to a certain stiffness of a section, the bending resistance of that section is important. In other words, how tightly or firmly that section holds the annular sealing body in the recess when the annular sealing body is in an assembled condition with the annular base. That is, the stiffness of a section is a relative measurement of the pressure of which the concerned annular wall portion (or portions) exerts on the annular sealing body in the recess in the assembled condition. Hence, by stating that the stiffness of a first section is different from a stiffness of a second section, it is indicated that the pressure of which the annular wall portion (or portions) of the first section exerts on the annular sealing body in the recess is either larger or smaller compared to the annular wall portion (or portions) of the second section.

The use of the sealing arrangement for garments should be understood that at least one of the layers to be sealed to the sealing arrangement is a garment. For example, the sealing arrangement may be sealingly connected to the annular layer of a kayak, and sealingly connected to the so called spray deck or spray shirt worn around the body of a kayak paddler, the latter layer being the wearable layer. The term wearable layer should be understood as a layer which is worn, e.g. a glove or a glove-shaped layer to sealingly reach the inside of a bag, or the spray deck or spray shirt already mentioned, or a silicone or latex seal. The sealing arrangement may be used to seal two garments and/or two wearable layers to the sealing arrangement. For example, the neck portion of a jacket or diving suit may be sealingly connected to the annular sealing surface of the sealing arrangement, the neck portion being the annular layer, and circumferentially and sealingly connected to a neck seal, or helmet by the annular sealing body, the neck seal or helmet being the wearable layer.

The annular shape of the sealing device and its various parts are to be understood as ring-shaped, i.e. as formed/shaped around an origin. The annular shape may e.g. be circular, essentially circular, oval, elliptical or formed in any other annular form. Thus, the sealing device may be formed to fit around the body e.g. the waste of a human, and/or limbs of a human, such as e.g. the neck, arms, hands, legs and wrists of a human.

It should be understood that the sealing device, and its related parts, e.g. the annular base and its annular wall portions, have an extension in the circumferential direction, i.e. in a direction around a periphery of the annular base, and an extension in the radial direction, i.e. in a direction perpendicular to the circumferential direction and directing from the inner annular wall portion towards the outer annular wall portion. In other words, the sealing arrangement, the sealing device and the annular base and the annular sealing body, may be described with cylindrical coordinates ($\rho$, $\varphi$, z), the circumferential direction corresponding to the direction of the angle $\varphi$ of the angular coordinate $\varphi$, the radial direction corresponding to a direction in the radial distance $\rho$, and the direction perpendicular to both the circumferential direction and the radial direction corresponding a direction along the height z. Correspondingly, in the connected state, the reinforcement clip may be described has having a main extension in the z-direction. The reinforcement clip may or may not be curved along the angular coordinate.

According to at least one example embodiment, at least one section in said plurality of sections has a different thickness compared to its neighbouring section, said thickness being defined in the direction from said inner annular wall portion to said outer annular wall portion.

Thus, the stiffness of at least two neighbouring sections is different by means of having different thickness. Hereby, a relatively simple means for providing sections with different stiffness are provided for. According to one example, all of the sections in the plurality of sections may have a different thickness, or the thickness may be alternated such that e.g. every other section has the same thickness. Other variations of the thickness of the sections are within the scope of the present inventive concept.

Hence, the reinforcement clip may be arranged between two sections having a greater thickness.

According to at least one example embodiment, two neighbouring sections comprises different types of materials, i.e. a first type section comprising a first material, and a second type section comprising a second material being different from the first material of sections of the first type section. The first material may provide a larger stiffness of the sections of the first type section compared to sections of the second type section. Hereby, a pressure of which the at least the inner annular wall portion and the outer annular wall portion exerts on the annular sealing body is larger for sections of the first type section. A reinforcement clip may thus preferably be attached to at least one of the sections of the second type section having a relatively low stiffness.

According to at least one example embodiment, said inner annular wall portion and/or said outer annular wall portion comprises an annular strengthening portion connecting at least every other section with each other.

Hereby, the overall stiffness of the annular base may be varied. For example, the strengthening portion may be made large in order to increase the stiffness of the sections and to more firmly hold/lock the annular sealing body in the recess, or in order to reduce the bendable properties of the annular base. The strengthening portion may be provided along the circumference of said inner annular wall portion and/or said outer annular wall portion, preferably along an edge of said inner annular wall portion and/or said outer annular wall. According to at least one example embodiment, the reinforcement clip is in use, configured to encompass at least a portion of the strengthening portion.

According to at least one example embodiment, said annular base comprises an annular shoulder arranged in said recess for reducing the risk of having said annular sealing body to be released when locked into said recess, said annular shoulder being arranged on the same inner annular wall portion and/our said outer annular wall portion as said annular strengthening portion but on an opposite side to said annular strengthening portion. According to at least one example embodiment, the first and or the second protruding portion of the reinforcement clip is arranged to, in use, be in contact with said annular shoulder.

The annular shoulder is preferably arranged along the circumference of the annular base. Hereby, the shoulder and the strengthening portion together provide for an increased stiffness of the sections, and/or provide for a better locking of the annular sealing body to the recess.

According to at least one example embodiment, said annular sealing surface is arranged in any one of the following: said inner annular wall portion, said outer annular wall portion, an annular flange connected to said outer annular wall portion, for circumferentially and sealingly connecting said annular layer by at least one of the following: adhesive means, welding, moulding, casting, laces.

The annular flange may be circumferentially and sealingly connected to the annular layer by any means known in the art. It should be understood that the annular layer is to be sealed to the annular sealing surface of said flange along the whole circumference of the annular flange in order to seal the sealing device from its surroundings. The annular sealing surface may be provided on either side or both sides of the annular flange.

According to at least one example embodiment, said annular sealing surface is arranged in said recess, and wherein said annular sealing body is adapted to be locked into said recess to circumferentially and sealingly connect said annular layer between said annular sealing surface and said annular sealing body.

Thus, both the annular layer and the wearable layer may be circumferentially and sealingly connected to the recess of the annular base by the annular sealing body. For example, in an assembled condition of the sealing device, i.e. when the annular sealing body is locked into the recess, the annular layer may be arranged furthest into the recess, and the wearable layer may be arranged between the annular layer and the annular sealing body in the recess. Hereby, the wearable layer may be removed and/or replaced without removing the annular layer from the recess.

According to at least one example embodiment, where the sealing surface is arranged the recess, the reinforcement clip improves the sealing properties between the sealing device and the wearable layer as well as between the sealing device and the annular layer.

Preferably, in an unassembled condition of the sealing device, i.e. when the annular sealing body is not locked into the recess of the annular base, the size and dimension of the recess, e.g. a cross section of the recess in the radial direction, is slightly smaller compared to the size and dimension of the annular sealing body, e.g. a cross section of the annular sealing body in the radial direction. However, when the annular sealing body is locked into the recess, by e.g. the means of an assembling tool, the material of the annular base allows for the recess to widen and the annular sealing body to be firmly locked into the recess. Hence, the sections of a larger stiffness will exert a larger pressure on the annular sealing body compared to the sections of a lesser stiffness.

Thus, according to at least one example embodiment, said annular base comprises a flexible material e.g. plastic such as polyurethane, or rubber or silicone.

According to at least one example embodiment, said annular base is moulded, e.g. injection-moulded or casted.

Hence, the annular base may be in one piece, and/or the annular sealing body may be made in one piece.

Hereby, a cost-effective and yet case-by-case adaptable method for producing the sealing device is provided for.

It should be noted that the term "at least one of said inner annular wall portion and said outer annular wall portion" may refer to one of said inner annular wall portion or said outer annular wall portion, i.e. either said inner annular wall portion or said outer annular wall portion, while at the same time the term is not excluding a reference to both of said inner annular wall portion and said outer annular wall portion.

According to at least a second aspect of the present inventive concept, a reinforcement clip for a sealing device having an annular base with an inner annular wall portion, an outer annular wall portion extending circumferentially around the inner annular wall portion, and a recess at least partly defined by the inner annular wall portion and the outer annular wall portion is provided, the sealing device being arranged to sealingly connect an annular layer and a wearable garment layer in the recess by an annular sealing body adapted to be locked into the recess, The reinforcement clip comprises:

a sealing device locking portion arranged at a first end portion of said reinforcement clip;

a counter acting portion arranged at a second end portion of said reinforcement clip; and a connecting portion connecting said sealing device locking portion and said counter acting portion wherein said sealing device locking portion is arranged to be locked to at least one of the inner annular wall portion and the outer annular wall portion of the sealing device, and said counter acting portion is configured to, in use, counter act a relative movement of the outer and inner annular wall portions whereby the risk of the annular sealing body to be released from the recess is reduced.

Effects and features of this second aspect of the present inventive concept are largely analogous to those described above in connection with the first aspect of the inventive concept. Embodiments mentioned in relation to the first aspect of the present inventive concept being related to the reinforcement clip are largely compatible with the second aspect of the inventive concept.

According to at least one example embodiment, said sealing device locking portion is formed as a protrusion, and wherein said protrusion is arranged to be snap-locked into an indentation in at least one of the inner annular wall portion and the outer annular wall portion of the sealing device.

According to at least one example embodiment, said counter acting portion comprises a base sub portion connected to said connecting portion, and a main protruding portion extending from said base sub portion at least partly in the same direction as said connecting portion, thereby forming a main reinforcement clip recess defined by at least a part of said connecting portion, at least a part of said base sub portion and at least a part of said main protruding portion.

According to at least one example embodiment, said main protruding portion is a first protruding portion and said main reinforcement clip recess is a first reinforcement clip recess, and said counter acting portion comprises a second protruding portion extending from said base sub portion at least partly in the same direction as said connecting portion, thereby forming a second reinforcement clip recess defined by at least a part of said base sub portion, at least a part of said first protruding portion and at least a part of said second protruding portion.

According to at least one example embodiment, said counter acting portion comprises a protrusion and wherein said protrusion is arranged to be snap-locked into an indentation in the inner annular wall portion of the sealing device.

According to at least one example embodiment, said sealing device locking portion comprises a surface configured to, in use, face at least a part of one of the inner annular wall portion and outer annular wall portion of the sealing device, and wherein said surface has an area larger than a cross sectional area of said connecting portion.

Hereby, the surface facing at least a part of one of the inner annular wall portion and outer annular wall portion of the sealing device provides means for transferring an external force subject to the sealing device to the reinforcement clip.

According to at least a third aspect of the present inventive concept, the use of a sealing arrangement according to the first aspect of the present inventive concept (and any embodiments thereof) is provided for. The use of the sealing arrangement comprises the steps of circumferentially and sealingly connect an annular layer to said annular sealing surface by adhesive means, welding, moulding, casting, and/or laces, and circumferentially and sealingly connect a wearable layer into said recess by snap locking said annular sealing body into said recess, and to connect a reinforcement clip to said annular base of said sealing device in order to counter act a relative movement of the outer and inner annular wall portions of the sealing device whereby the risk of said annular sealing body to be released from said recess is reduced. Hereby, said wearable layer will be secured between the annular base and the annular sealing body.

Effects and features of this third aspect of the present inventive concept are largely analogous to those described above in connection with the first aspect of the inventive concept. Embodiments mentioned in relation to the first aspect of the present inventive concept are largely compatible with the third aspect of the inventive concept.

According to at least one example embodiment, the use of the sealing device comprising the step of circumferentially and sealingly connect the neck and/or cuffs of a jacket or suit, such as e.g. a diving suit, to said annular sealing surface by adhesive means, welding, moulding, casting, and/or laces, and circumferentially and sealingly connect a sealing cuff by locking said sealing cuff into said recess by said annular sealing body.

BRIEF DESCRIPTION OF THE DRAWINGS

The present inventive concept will now be described in more detail, with reference to the illustrative and non-limiting appended drawings showing example embodiments of the inventive concept, wherein.

DETAILED DESCRIPTION OF THE DRAWINGS

Figure 1:
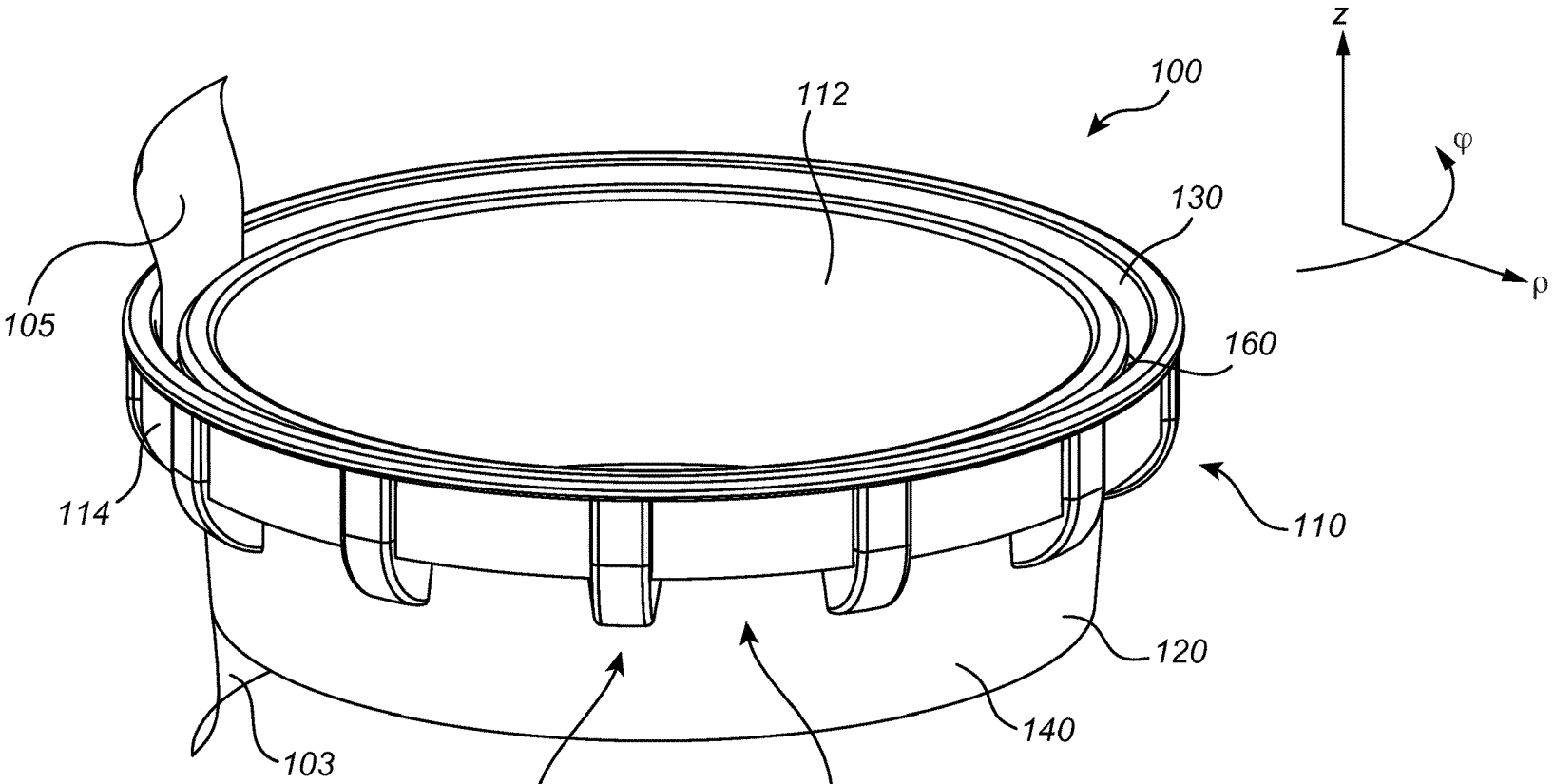
FIG. 1 is a perspective view illustrating a sealing device of the sealing arrangement according to least one example embodiment of the inventive concept.

The above, as well as additional objects, features and advantages of the present inventive concept, will be better understood through the following illustrative and non-limiting detailed description of example embodiments of the present inventive concept, with reference to the appended drawings where the same reference numerals will be used for similar elements.

Figure 2:
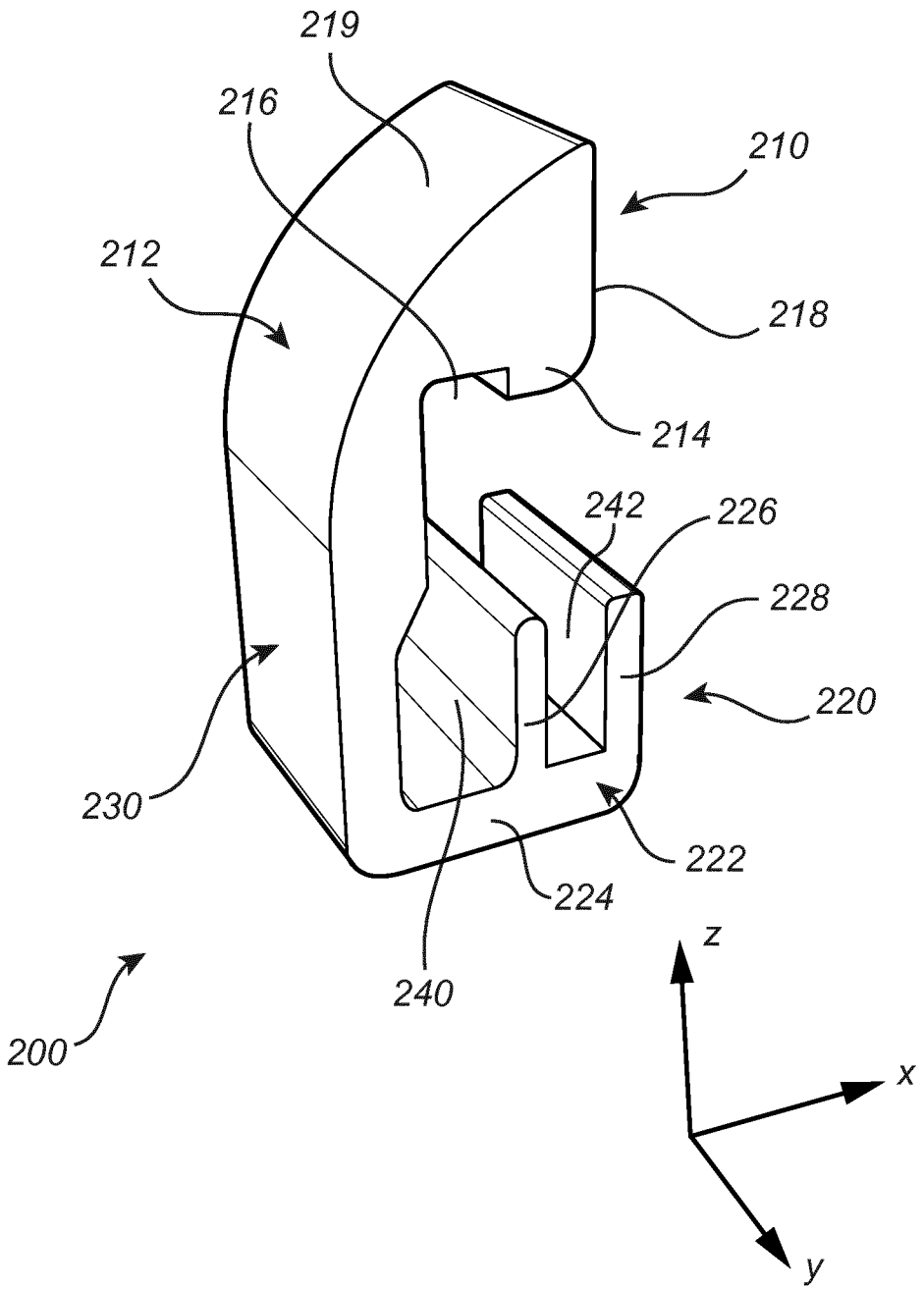
FIG. 2 is a perspective view illustrating a reinforcement clip of the sealing arrangement according to least one example embodiment of the inventive concept.
Figure 3:
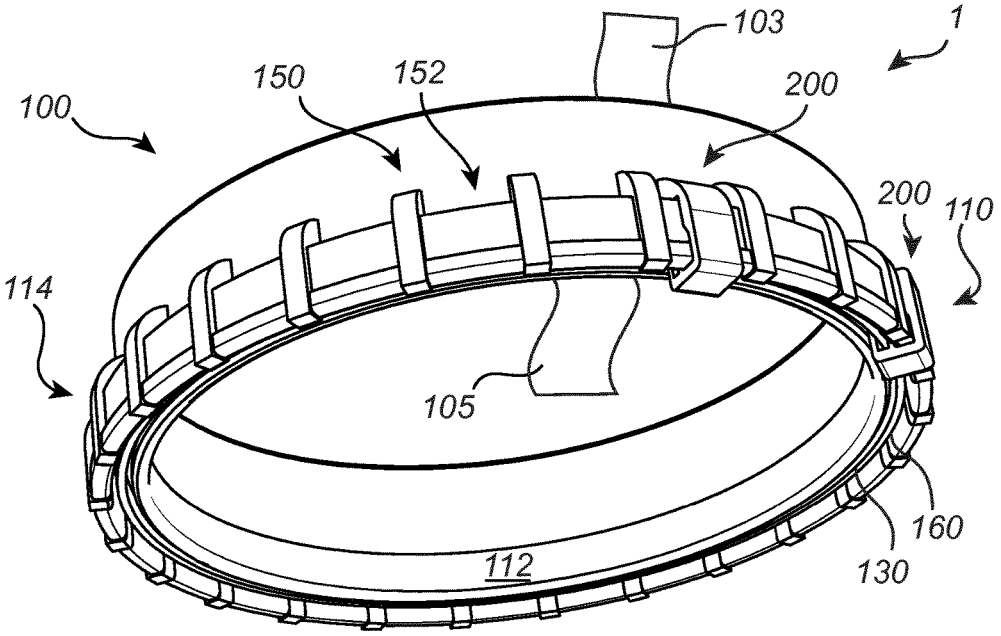
FIG. 3 is a perspective view illustrating a sealing arrangement in use when sealingly connecting an annular layer and a wearable layer according to at least one example embodiment of the inventive concept.
Figure 4:
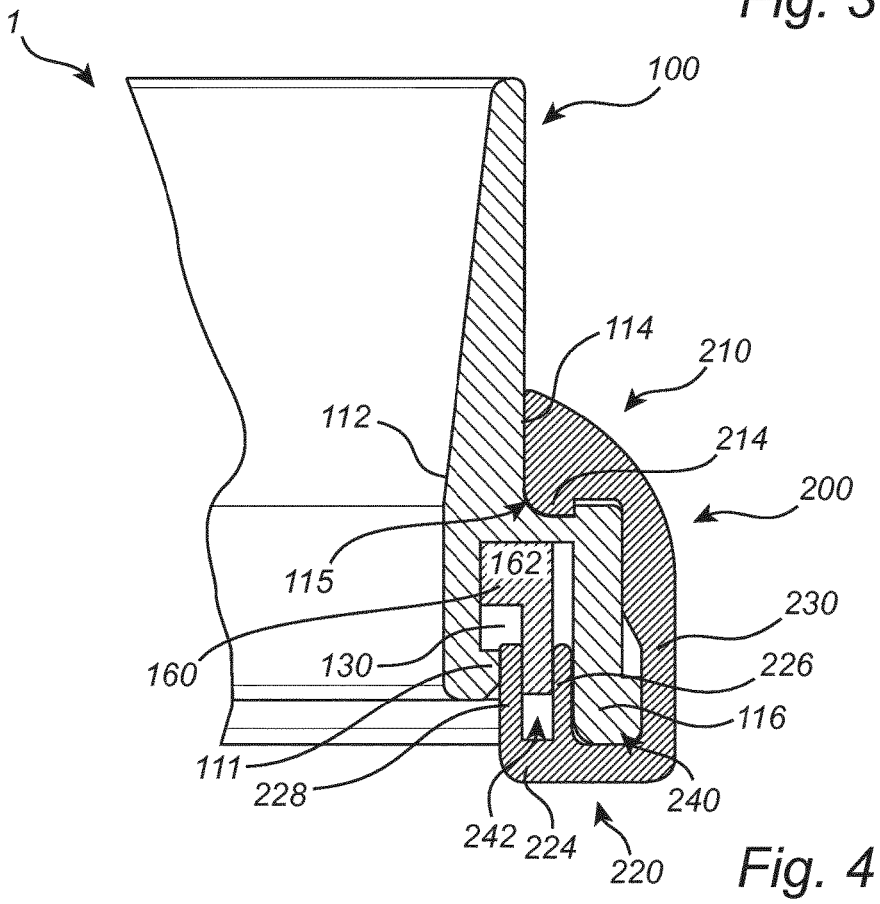
FIG. 4 illustrates in cross-section a detail of the example embodiment in FIG. 3.

FIG. 1 illustrates a sealing device 100, FIG. 2 illustrates a reinforcement clip 200, FIG. 3 illustrates a sealing arrangement 1 comprising the sealing device 100 of FIG. 1 and the reinforcement clip 200 of FIG. 2, and FIG. 4 illustrates in cross section a detail of FIG. 3. The sealing arrangement 1 is intended to be used for garments to sealingly connect an annular layer 103 (only shown in part) and a wearable layer 105 (only shown in part) to the sealing arrangement 1, for example, the sealing arrangement 1 is suited for sealing the cuff and/or wrist portion 103 of a diving suit or jacket to a wrist and/or cuff seal 105 respectively.

First, the sealing device 100 will be described with reference to FIG. 1, and after that the reinforcement clip 200 will be described with reference to FIG. 2, and subsequently the function of the sealing arrangement 1 will be described with reference to FIG. 3 and FIG. 4.

FIG. 1 illustrates a sealing device 100 comprised in a sealing arrangement 1 (shown in FIG. 3). The sealing device 100 comprises an annular sealing body 160 and an annular base 110. The annular base 110 comprises an inner annular wall portion 112, an outer annular wall portion 114 extending circumferentially around the inner annular wall portion 112. A recess 130 is arranged in the annular base 110, at least partly between the inner annular wall portion 112 and the outer annular wall portion 114. The recess 130 is arranged to receive the annular sealing body 160 in such a way that the annular sealing body 160 can be locked into the recess 160 to circumferentially and sealingly connect the wearable layer 105 between the annular base 110 and the annular sealing body 160.

It should be understood that the sealing device 100, e.g. the annular base 110 and its related parts, e.g. the annular wall portions 112, 114, have an extension in the circumferential direction, i.e. in a direction around a periphery of the annular base 110, and an extension in the radial direction, i.e. in a direction perpendicular to the circumferential direction and directing from the inner annular wall portion 112 towards the outer annular wall portion 114. In other words, the sealing device 100, and the annular base 110 and the annular sealing body 160, may be described with cylindrical coordinates ($\rho$, $\varphi$, z), the circumferential direction corresponding to the direction of the angle $\varphi$ of the angular coordinate $\varphi$, the radial direction corresponding to a direction of the radial distance $\rho$, and the direction perpendicular to both the circumferential direction and the radial direction corresponding to a direction of the height z.

In FIG. 1, the outer annular wall portion 114 is provided with/divided into a plurality of sections in the circumferential direction. There are two different types of sections, a first type section 150 comprising a flat part and a rounded part, the rounded part tapering in a direction being perpendicular to the circumferential direction and the radial direction (i.e. in the z-direction), and a second type section 152 comprising only a flat part. Sections of the first type section 150 extend further in the direction perpendicular to the circumferential and radial direction (i.e. in the z-direction) compared to sections of the second type section 152. Thus, sections of the first type section 150 comprises more material compared to section of the second type section 152, providing for a larger stiffness of sections of the first type section 150. Hereby, a pressure of which at least the inner annular wall portion 112 and the outer annular wall portion 114 exert on the annular sealing body 160 in the recess 130 is larger for sections of the first type section 150. In FIG. 1, the alternating arrangement of the first and second type sections 150, 152, provides for that each section has a stiffness different from a stiffness of its neighbouring section. Hereby, the sections of the annular base 110, and more specifically, inner surfaces of the inner and outer annular wall portions 112, 114 exert a pressure to hold the annular sealing body 160 in the recess 130 in order to sealingly connect the annular base 110 to the wearable layer 105 along the whole periphery of the recess 130 in the circumferential direction, while at the same time provide for a flexibility of the annular base 110 such that the annular base 110 may be more bendable when a force is applied in a direction perpendicular to the circumferential and radial direction (i.e. in the z-direction) compared to an annular base without such sections.

An annular flange 120 in FIG. 1 extends in a direction perpendicular to the circumferential and radial direction (i.e. in the z-direction) of the annular base 110, and may be seen as an extension of the inner and/or outer annular wall portions 112, 114. The annular flange 120 may comprise an annular sealing surface 140 for circumferentially and sealingly connecting the annular layer 103 to the sealing device 100 e.g. by means of an adhesive, by welding, by moulding, by casting, by laces or by any other suitable means. The annular flange 120, and thus the annular sealing surface 140, e.g. being an extension of the inner annular wall portion 112 makes it suitable for sealingly connect a glove 105 or cuff sealing 105 to the cuff portion 103 of e.g. a jacket or a diving suit, or to sealingly connect a boot 105 to the wrist portion 103 of e.g. a pair of rain pants or a diving suit.

FIG. 2 illustrates a reinforcement clip 200 comprised in a sealing arrangement 1 (shown in FIG. 3). The reinforcement clip 200 comprises a sealing device locking portion 210 arranged at a first end portion 212 of the reinforcement clip 200, and a counter acting portion 220 arranged at a second end portion 222 of the reinforcement clip 200. The sealing device locking portion 210 and the counter acting portion 220 is connected to each other by a connecting portion 230.

As shown in FIG. 2, the counter acting portion 220 comprises a base sub portion 224 connected to the connecting portion 230, and a first protruding portion 226 extending from the base sup portion 224 in the same direction as the connecting portion 230 (i.e. at least partly towards the sealing device locking portion 210). Hereby, a first reinforcement clip recess 240 is formed, being defined by at least a part of the connecting portion 230, at least a part of the base sub portion 224 and at least a part of the first protruding portion 226.

In FIG. 2, the reinforcement clip 200 and the counter acting portion 220 comprises a second protruding portion 228 extending from the base sub portion 224 in the same direction as the connecting portion 230 (and in the same direction as the first protruding portion 226), thereby forming a second reinforcement clip recess 242 defined by at least a part of the base sub portion 224, at least a part of the first protruding portion 226 and at least a part of the second protruding portion 228.

According to at least one example embodiment, the reinforcement clip 200 comprises only the first protruding portion 226 and the first reinforcement clip recess 240, and not the second protruding portion 228 and the second reinforcement clip recess 242. The first protruding portion 226 may thus be referred to as a main protruding portion 226 and the first reinforcement clip recess 240 may be referred to as a main reinforcement clip recess 240.

It should be understood that the reinforcement clip 200 and its related portions may be described in a Cartesian coordinate system, i.e. in a coordinate system having x-, y- and z-coordinates. Thus, the reinforcement clip may be described as having an extension in the z-direction, i.e. in a direction from the sealing device locking portion 210 towards the counter acting portion 220 (in other words the length of the reinforcement clip 200), and an extension in the x-direction, i.e. in a direction from the connecting portion 230 towards the first and the second protruding portions 226, 228 (in other words the depth of the reinforcement clip 200), and an extension in the y-direction, i.e. in a direction being perpendicular to both the z- and x-directions (in other words the width of the reinforcement clip 200). When the reinforcement clip 200 is attached to the sealing device 100 (as shown in FIG. 3), the reinforcement clip 200 and its related portions may be described in the same reference coordinate system as the sealing device 100 of FIG. 1. Thus, the z-direction of the sealing device 100 coincides with the z-direction of the reinforcement clip 200, the direction along the angle φ at least partly coincides with the y-direction of the reinforcement clip 200, and the radial p direction at least partly coincides with the x-direction of the reinforcement clip 200.

Thus, the connecting portion 230, the first and the second protruding portions 226, 228 can be described as having a main extension in the z-direction, while the base sup portion 224 can be described as having a main extension in the x-direction. The width of the reinforcement clip 200, i.e. its extension in the y-direction is preferably uniform.

As illustrated in FIG. 2, the sealing device locking portion 210 comprises a protrusion 214 forming a locking recess 216 together with at least a part of the connecting portion 230. The protrusion 214 extends in the z-direction at least partly towards the base sup portion 224 of the counter holding portion 220. Furthermore, the sealing device locking portion 210 comprises a sealing device contact surface 218, which in use, is arranged to face at least a part of the inner or outer annular wall portion of the sealing device 100. The size of the sealing device contact surface 218 may according to at least one example embodiment be larger than a cross sectional surface of the connecting portion 230 taking in a x, y-plane. Furthermore, as shown in FIG. 2, a bevelled surface 219 is arranged on an opposite side of the first end portion 212 as compared to the sealing device contact surface 218. The bevelled surface 219 of the first end portion is adjacent to the connecting portion 230.

The function of the sealing arrangement 1 comprising the sealing device 100 and the reinforcement clip 200 will now be described in detail with reference to FIG. 3 and FIG. 4. As the sealing arrangement 1 in FIG. 3 and FIG. 4 comprises the sealing device 100 of FIG. 1 and the reinforcement clip 200 of FIG. 2, the same reference numeral are used. First, the function of the annular sealing body 160 and the recess 130 will be described, and subsequently the function of the reinforcement clip 200 in relation to the sealing device 100 will be described.

As explained above, the sealing device 100 comprises an annular sealing body 160 which is adapted to be locked into the recess 130 to circumferentially and sealingly connect the wearable layer 105 between the annular base 110 and the annular sealing body 160. The size and dimension of a cross section in the radial direction of the recess 130 corresponds largely to the size and dimension of a cross section in the radial direction of the annular sealing body 160. In the unassembled condition, the size and dimension of the recess 130 may be somewhat smaller compared to the size and dimension of the annular sealing body 160. As the annular base 110 preferable is made of a flexible material, e.g. by a plastic such as polyurethane or rubber or silicone, the size and dimension of the recess 130 may be expanded as the annular sealing body 160 is pressed into the recess 130. Thus, in the assembled condition, at least the inner annular wall portion 112 and the outer annular wall portion 114 exerts a pressure on the annular sealing body 160, via the wearable layer 105, in such a way that the wearable layer 105 is sealingly secured between the annular sealing body 160 and the recess 130, as the annular sealing body 160 is locked into the recess 130. In other words, an internal surface of (or the inside of) each of the inner annular wall portion 112 and the outer annular wall portion 114 exerts a pressure on the annular sealing body 160, via the wearable layer 105, in order to secure the wearable layer 105 between the annular base 110 and the annular sealing body 160.

The pressure of which the at least the inner annular wall portion 112 and the outer annular wall portion 114 exerts on the annular sealing body 160 is related to the stiffness of the sections. As illustrated in FIG. 1 and FIG. 3, sections of the first type section 150, is thicker than sections of the second type section 152, and thereby exert a larger pressure on the annular sealing body 160 as the stiffness of the sections of the first type section 150 is larger compared to sections of the second type section 152. In FIG. 1 and FIG. 3, the alternating arrangement of the sections of the first and second type section 150, 152, provides for that each section has a stiffness different from a stiffness of its neighbouring section. Hereby, the sections of the annular base 110, and more specifically, at least the inner annular wall portion 112 and the outer annular wall portion 114 exerts a pressure to hold the annular sealing body 160 in the recess 130 in order to sealingly connect the annular base 110 to the wearable layer 105 along the whole periphery of the recess in the circumferential direction, while at the same time provide for a flexibility of the annular base 110 such that the annular base 110 may be more bendable around an axis of the annular base 110, e.g. bendable when a force is applied in a direction perpendicular to the circumferential and radial direction (i.e. in the z-direction) compared to an annular base without such sections.

The function of the reinforcement clip 200 will now be described in more detail with reference to FIG. 4 illustrating in cross section a part of the sealing device 100 and the reinforcement clip 200. The sealing device locking portion 210 of the reinforcement clip 200 is arranged to be locked to the sealing device 100. In particular, the sealing device locking portion 210 is arranged to, in use, be locked to one of the inner annular wall portion 112 and outer annular wall portion 114 of the sealing device 100. Hereby, one end portion 212 of the reinforcement clip 200 is locked to the sealing device 100. As illustrated in FIG. 4 (and in FIG. 3), the sealing device locking portion 210 is locked to the outer annular wall portion 114.

As the connecting portion 230 of the reinforcement clip 200 extends from the sealing device locking portion 210 along the outer annular wall portion 112, a portion of the counter acting portion 220 (such as the base sub portion 224 of the counter acting portion 220) is allowed to extend in the radial direction towards a centreline of the sealing device 100. Hereby a portion of the counter acting portion 220 (such as the first and/or the second protruding portion 226, 228) can extend into the recess 130 and thereby be secured by the inner surfaces of the inner and outer annular wall portions 112, 114. Thus, by having the sealing device locking portion 210 locked to the sealing device 110, the counter acting portion 220 being secured in the recess 130 may counter act a relative movement of the outer and inner annular wall portions 112, 114. Hereby the risk of the annular sealing body 160 to be released from the recess 130 is reduced.

As can be seen in FIG. 4, the outer annular wall portion 114 comprises a reinforcement clip-locking portion 115 arranged to lock against the sealing device locking portion 210. More specifically, the reinforcement clip-locking portion 115 is formed as an indentation 115 in the outer annular wall 114, and the protrusion 214 of the sealing device locking portion 220 is arranged to be snap-locked into the indentation 115. Furthermore, when the protrusion 214 is snap-locked into the indentation 115, an end portion 116 of the outer annular wall portion 114 is extending into the first reinforcement clip recess 240. Thus, the first protruding portion 226, at least a part of the base sub-portion 224 and at least a part of the connecting portion 230 encompasses the end portion 116 of the outer annular wall portion 114 extending into the first reinforcement clip recess 240. According to at least one example embodiment, the end portion 116 has an extension in the radial direction which is larger compared its neighbouring portion of the outer annular wall portion 114. However, according to at least one example embodiment, the end portion 116 has an extension in the radial direction which is the same, or very similar to, the its neighbouring portion of the outer annular wall portion 114.

The second protruding portion 228, a top orifice of the second reinforcement clip recess 242, and the first protruding portion 226 is, in use (as seen in FIG. 4), arranged to face, and possibly be in contact with, the annular sealing body 160. Hence, at least the first and the second protruding portions 226, 228 are arranged to hold the annular sealing body 160 in the recess 130. Furthermore, the second reinforcement clip recess 242 may function as a receiving recess 242 for the annular sealing body 160 in case the annular sealing body 160 is beginning to creep out of the recess 130.

The first and second protruding portions 226, 228 is, in use (as seen in FIG. 4), arranged between the inner annular wall portion 112 and the outer annular wall portion 114, at least partly inside the recess 130.

Thus, the reinforcement clip 200 reduces the risk of the annular sealing body 160 to creep out of the recess 130, e.g. by reducing the risk of a relative movement of the annular inner and outer wall portions 112, 114 (which otherwise would cause the recess to be enlarged), when the sealing arrangement 1 is subject to an external force.

As also illustrated in FIG. 4, the annular base 110 may comprises an annular shoulder 111 arranged in the recess 130 for further reducing the risk of having the annular sealing body 160 to be released when locked into the recess 130. Correspondingly, the annular sealing body 160 may comprise a lip 162 extending towards an opening of the recess 130, possibly in juxtaposition to the shoulder 111 and possible extending outside the opening of the recess 130. The lip 162 helps to prevent the annular sealing body 160 to move in the circumferential direction during e.g. assembling/unassembling of the annular sealing body 160 to the recess 130.

As shown in both FIG. 2 and FIG. 4, the connecting portion 230 may have a varying extension in the x-direction, as the surface of the connecting portion 230 facing at least partly towards the first protruding portion 226 is non-flat. However, according to at least one example embodiment, the connecting portion 230 has a uniform extension in the x-direction. For example, the above mentioned surface of the connecting portion 230 may be flat.

The annular sealing body 160 may be released from the recess 130 when no reinforcement clip 200 is locked to the sealing device 100 by gripping a strengthening portion connecting at least the sections of the first type section 150. The user may grip and bend the strengthening portion in the radial direction such that the recess 130 is enlarged and the annular sealing body 160 may be released from the recess 130. This may be desirable when the wearable layer 105 being sealingly connected to the annular base 110 by the annular sealing body 160 is to be removed and/or replaced.

Figure 5:
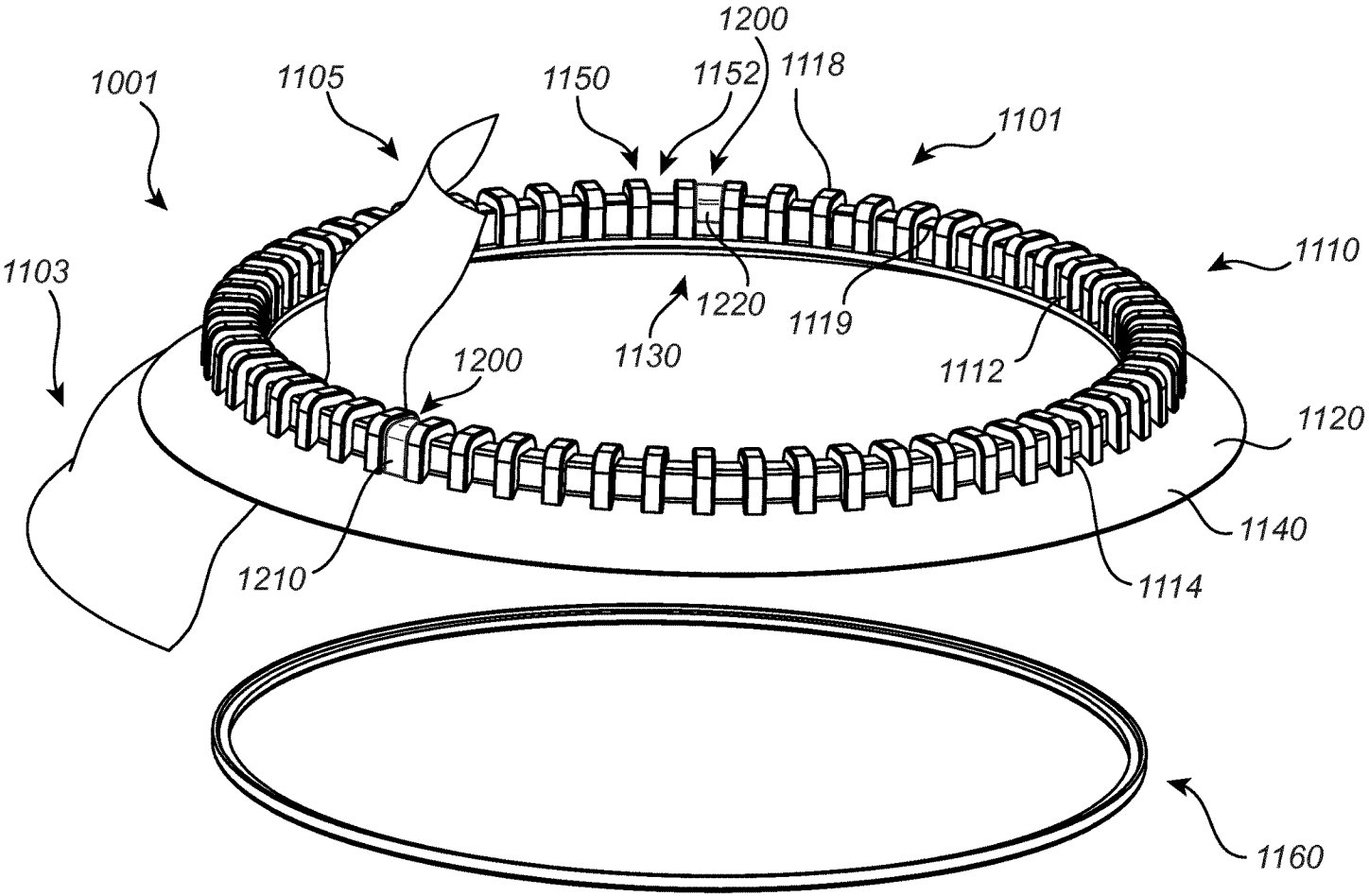
FIG. 5 illustrates a sealing arrangement according to another example embodiment of the inventive concept.

In FIG. 5 a sealing arrangement 1001 for garments similar to the sealing device 1 described with reference to FIGS. 1-4 is illustrated. Sealing device 1001 is suited for sealing the neck portion 1103 of a diving suit or jacket to a neck seal 1105. That is, to sealingly connect an annular layer 1103 (only shown in part) and a wearable layer 1105 (only shown in part) to the sealing device 1001. Similar or corresponding parts, portions and elements between FIGS. 1-4 and FIG. 5 will be referred to with corresponding reference numerals, but with the addition of the value "1000" for the reference numerals in FIGS. 1-4, i.e. reference numeral "130" indicating the recess 130 in FIGS. 1, 3 and 4 will be referred to with reference numeral "1130" indicating a recess 1130 in FIG. 5. These parts, portions and elements will not be explained further if the structure and function are essentially the same as for the sealing device 1 of FIGS. 1-4.

In FIG. 5 the inner annular wall portion 1112 and the outer annular wall portion 1114 of the sealing device 1100 are connected by a connecting annular wall portion 1118. The three wall portions 1112, 1114, 1118 are all provided with/divided into a plurality of sections in the circumferential direction, similar to the sections of the sealing device 100 in FIGS. 1, 3 and 4 (i.e. two different types of sections 1150, 1152 of providing different stiffness to the base portion 1110). According to yet at least one example embodiment, the inner annular wall portion 1112 may be directly connected to the outer annular wall portion 1114 with or without a transition, e.g. to constitute a common rounded wall portion, for at least one of the first and second type section 1150, 1152. The recess 1130, being defined by inside surfaces (or an inside of) the annular wall portions 1112, 1114, 1118 have a shape corresponding to the annular walls in at least one of the first and second type section 1150, 1152.

The sealing device 1101 in FIG. 5 further comprises an annular flange 1120 extending circumferentially of the outer annular wall portion 1114. The annular flange 1120 has a radial extension in a direction heading away from the outer annular wall portion 1114, with an angle between the radial extension of the annular flange 1120 and the outer annular wall portion 1114 of over 90°, e.g. between 120° and 150°, e.g. approximately 135°. An annular sealing surface 1140 is comprised on at least one side of the annular flange 1120. The annular sealing surface 1140 is adapted to circumferentially and sealingly connect the annular layer 1103 to the sealing device 1001 e.g. by means of an adhesive, by welding, by moulding, by casting, by laces or by any other suitable means. It should be understood that the annular layer 1103 may be attached to the annular sealing surface 1140 by any means applicable, the important feature being that the annular sealing surface 1140 is sealingly connected to the annular layer 1103 along the whole circumference of the annular sealing surface 1140.

Similar to the sealing device 100 in FIGS. 1, 3 and 4, the sealing device 1100 comprises an annular sealing body 1160 which is adapted to be locked into the recess 1130 to circumferentially and sealingly connect the wearable layer 1105 between the annular base 1110 and the annular sealing body 1160.

The reinforcement clip 1200 of the sealing arrangement 1001 in FIG. 5 is somewhat different to the reinforcement clip 200 of the sealing arrangement 1 in FIGS. 2, 3 and 4. In FIG. 5, in addition to the protrusion (from now on being referred to as a first protrusion) of the sealing device locking portion 1210, the counter acting portion 1220 of the reinforcement clip 1200 comprises a second protrusion. Correspondingly and in addition to the indentation of the outer annular wall portion 1114 (from now on being referred to as the first indentation) arranged to be locked in with the first protrusion, the inner annular wall portion 1114 comprises a second indentation arranged to be snap-locked with the second protrusion. The reinforcement clip 1200 may be described as having two sealing device locking portions, each arranged at a respective end portion of the reinforcement clip. According to at least one example embodiment, the reinforcement clip 1200 is symmetrical along a center axis of the reinforcement clip 1200.

The function of the reinforcement clip 1200 in FIG. 5 is very similar to the function of the reinforcement clip 200 in FIGS. 2, 3 and 4, of course with the difference that the reinforcement clip 1200 is, in use, snap-locked to both the outer and inner annual wall portions 1112, 1114 of the sealing device 110, why it is not repeated in full again here. However, in short, the reinforcement clip functions as a reinforcement of at least one of the sections of the second type section 1152 providing a relatively low stiffness, and reduces the risk of the annular sealing body 1160 to creep out of the recess 1130 by counter acting a relative movement of the inner and outer wall portions 1112, 1114.

Figure 6:
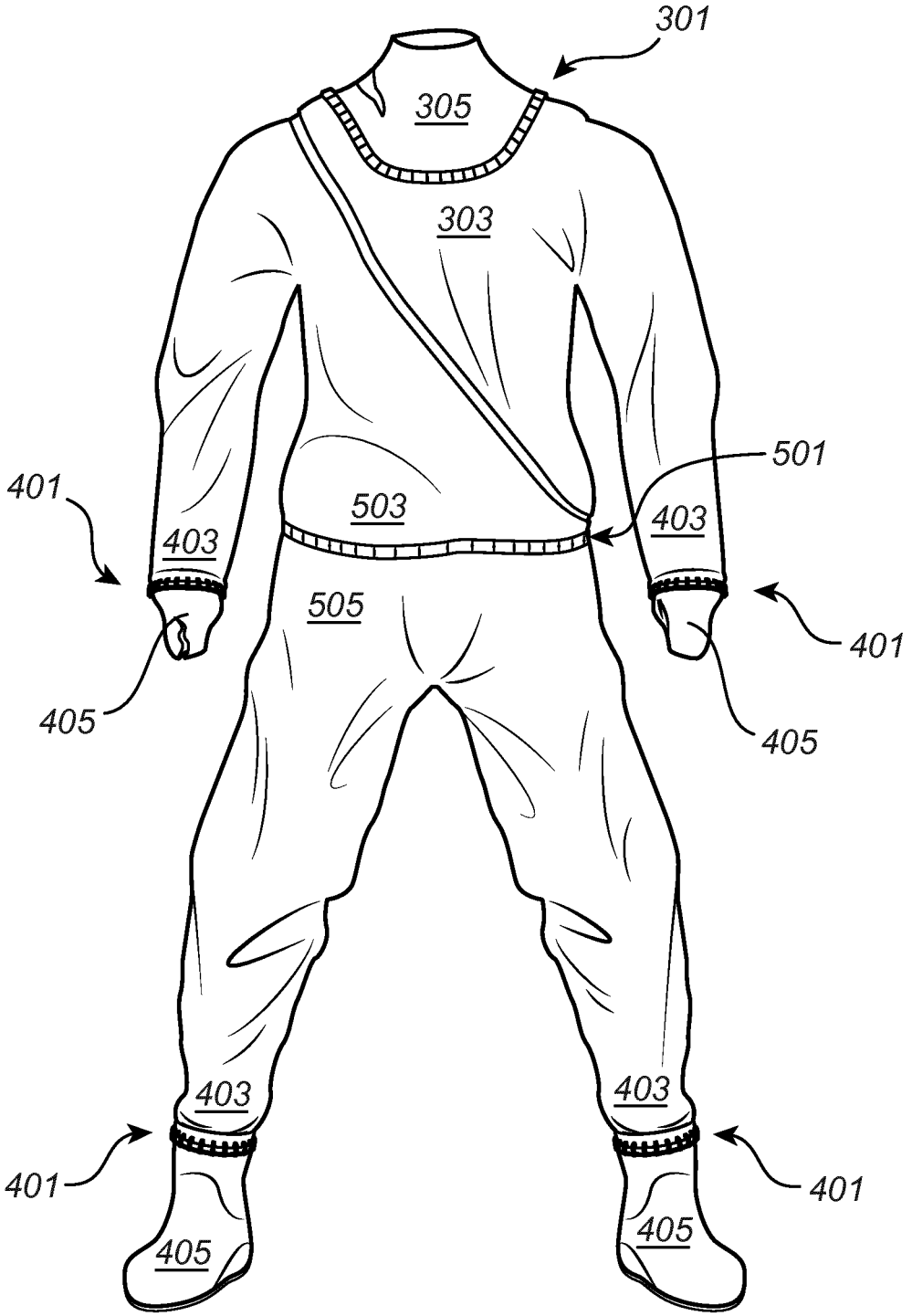
FIG. 6 illustrates the use of a sealing arrangement according to at least one example embodiment of the inventive concept.

FIG. 6 illustrates the use of sealing arrangements 301, 401, 501 in a suit such as e.g. a diving suit or a jacket, e.g. a rain jacket, and pants, where the neck portion 303, the cuffs of the arms 403 and wrists of the legs 403, and the waistline 503 are provided with such sealing arrangements 301, 401, 501. The neck portion 303 and the waistline portion 503 are preferably provided with a sealing arrangement 301, 501 similar to the embodiment described in relation to FIG. 5, while the cuffs of the arms 403 and the wrists 403 of the pants preferably are provided with a sealing arrangement 401 similar to the embodiment described in relation to FIGS. 1-4.

For the neck portion 303, the sealing arrangement 301 may sealingly and circumferentially connect the neck portion 303 around its periphery by means of e.g. adhesive, welding means, moulding means, casting means, laces or the like, to a neck seal 305. The neck seal 305 being circumferentially and sealingly connected to the sealing arrangement 301 as previously described. Similarly, the waistline 503 and a waistline seal 505, or a pair of pants 505, are sealingly and circumferentially connected to the sealing arrangement 501 around its periphery by means of e.g. adhesive, welding means, moulding means, casting means, laces or by being locked into a recess of the sealing device by an annular sealing body as previously described. The sealing arrangement 401 may circumferentially and sealingly connect the cuffs of the arms 403 to e.g. hand seals 405 or gloves 405, and the wrist of the pants 403 to e.g. a boot 405, to the sealing arrangement 401 by means previously described.

It should be noted that the sealing arrangements 1, 1001 presented here is specifically suited for an easy removal and replacement of the layer being locked into the recess 130, 1130 by the annular sealing body 160, 1160. Hence, if the wearable layer 105, 1105, for some reason are broken or dysfunctional, the wearable layer 105, 1105, may easily be replaced by removing the annular sealing body 160, 1160 and realising the wearable layer 105, 1105 and replacing it with a new layer 105, 1105.

The person skilled in the art realizes that the present inventive concept by no means is limited to the embodiments described above. For example, other distributions of the sections, other locking means for the annular sealing body, and other shapes and orientations of the annular flange than presented here are applicable and the sealing device may be used for other purposes than those explicitly mentioned here. Furthermore, other shapes and orientations of the reinforcement clip, and/or other directions of which the reinforcement clip locks to the sealing device are with the scope of the present inventive concept.

The invention claimed is:

1. A sealing arrangement for garments to sealingly connect an annular layer and a wearable layer to said sealing arrangement, said sealing arrangement comprises a sealing device and a reinforcement clip, said sealing device comprising an annular sealing body and an annular base, said annular base comprising:

an inner annular wall portion, an outer annular wall portion extending circumferentially around said inner annular wall portion, a recess at least partly defined by said inner and outer annular wall portions, and an annular sealing surface for circumferentially and sealingly connecting said annular layer to said annular base;

said annular sealing body being adapted to be locked into said recess to circumferentially and sealingly connect said wearable layer between said annular base and said annular sealing body;

said reinforcement clip comprising a sealing device locking portion arranged at a first end portion of said reinforcement clip, a counter acting portion arranged at a second end portion of said reinforcement clip, and a connecting portion connecting said sealing device locking portion and said counter acting portion;

wherein said sealing device locking portion is arranged to be locked to at least one of said inner annular wall portion and said outer annular wall portion of said sealing device and said counter acting portion is configured to, in use, counter act a relative movement of the outer and inner annular wall portions whereby the risk of said annular sealing body to be released from said recess is reduced, wherein said counter acting portion comprises a base sub portion connected to said connecting portion, and a main protruding portion extending from said base sub portion at least partly in the same direction as said connecting portion, thereby forming a main reinforcement clip recess defined by at least a part of said connecting portion, at least a part of said base sub portion and at least a part of said main protruding portion.

2. A sealing arrangement according to claim 1, wherein at least one of said inner annular wall portion and said outer annular wall portion of said sealing device comprises a reinforcement clip-locking portion arranged to lock against said sealing device locking portion.

3. A sealing arrangement according to claim 2, wherein said reinforcement clip-locking portion is formed as an indentation, and said sealing device locking portion is formed as a protrusion, and wherein said protrusion is arranged to be snap-locked into said indentation.

4. A sealing arrangement according to claim 1, wherein said main protruding portion is a first protruding portion and said main reinforcement clip recess is a first reinforcement clip recess, and wherein said counter holding portion comprises a second protruding portion extending from said base sub portion at least partly in the same direction as said connecting portion, thereby forming a second reinforcement clip recess defined by at least a part of said base sub portion, at least a part of said first protruding portion and at least a part of said second protruding portion.

5. A sealing arrangement according to claim 1, wherein said counter acting portion comprises a protrusion and both of said inner annular and outer annular wall portions comprise an indentation, and wherein said protrusion of said counter acting portion is arranged to be snap-locked into one of said indentation.

6. A sealing arrangement according to claim 1, wherein at least one of said inner annular wall portion and said outer annular wall portion is provided with a plurality of sections in the circumferential direction, each section having a stiffness different from a stiffness of a neighbouring section.

7. A sealing arrangement according to claim 1, wherein said annular sealing surface is arranged in any one of the following: said inner annular wall portion, said outer annular wall portion, an annular flange connected to said outer annular wall portion, for circumferentially and sealingly connecting said annular layer by at least one of the following: adhesive means, welding, moulding, casting, laces.

8. A sealing arrangement according to claim 1, wherein said annular sealing surface is arranged in said recess, and wherein said annular sealing body is adapted to be locked into said recess to circumferentially and sealingly connect said annular layer between said annular sealing surface and said annular sealing body.

* * * * *